United States Patent [19]

Berge

[11] 4,152,681

[45] May 1, 1979

[54] METHOD AND DEVICE FOR SIMPLIFIED CONNECTION OF TWO CIRCULAR WAVE GUIDES

[75] Inventor: Jean Berge, Lyon, France

[73] Assignee: Les Cables de Lyon, Lyon, France

[21] Appl. No.: 793,893

[22] Filed: May 4, 1977

[30] Foreign Application Priority Data

May 12, 1976 [FR] France ..... 76 14283

[51] Int. Cl.[2] ..... H01P 1/04; H01P 3/12; H01P 11/00

[52] U.S. Cl. ..... 333/254; 29/600; 333/239

[58] Field of Search ..... 333/98 R, 98 P, 95 R, 333/84 R, 97 R, 96; 138/155; 285/405, 406, 413, 416, 286; 29/600; 174/21 R, 21 C, 75 R, 88 C

[56] References Cited

U.S. PATENT DOCUMENTS 3,947,785 3/1976 Ferrentino ..... 333/98 R

*Primary Examiner*—Alfred E. Smith
*Assistant Examiner*—Marvin Nussbaum
*Attorney, Agent, or Firm*—Haseltine, Lake & Waters

[57] ABSTRACT

A method and device enabling simplified connection of two circular wave guides and reduction of the manufacturing price. The method consists of expanding the outer steel casings so as to form flanges on the end of sleeves having a larger diameter than the remainder of the casing. The inner guides are connected together by hoops and possibly a clamp ring. The flanges are then welded together. Application to electromagnetic wave guides.

5 Claims, 8 Drawing Figures

METHOD AND DEVICE FOR SIMPLIFIED CONNECTION OF TWO CIRCULAR WAVE GUIDES

Figure 1A:
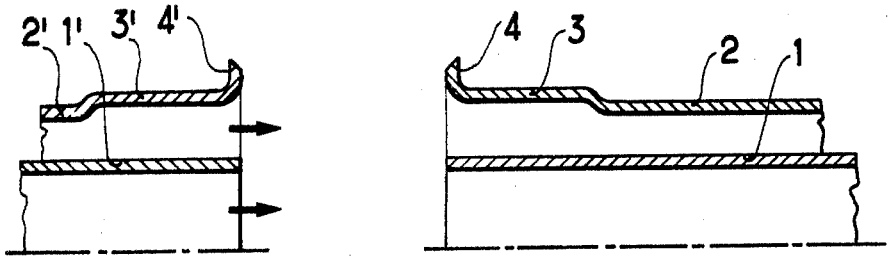

The present invention relates to a simplified method and device for connecting together two circular wave guides using in particular the TE01 propagation mode.

It is known that the connection of two circular wave guides using the TE01 mode requires great precision in the alignment of the axes of two neighbouring elements. This precision can be obtained only by a careful preparation of the ends of the wave guides to be connected together. If these ends are not welded together, it is necessary to machine them carefully and also to use high-precision connection parts having complex shapes. Indeed, up till now, end pieces have been provided which are welded onto each end of the wave guides and comprise circular projections whose diameter corresponds (within a few hundredths of a millimeter to the diameter of the circular groove of the end piece opposite to it, the two end pieces then being clamped by a collar. Any defect in the fit causes the connection to be thrown off centre. If, alternatively, the ends of the wave guides are welded, it is necessary to maintain the required precision in the parallelism of the axes of the guides by carefully machining the ends and the use of aligning devices when welding. As the length of the elementary sections of the wave guides is not greater than ten or so meters, it will be understood that the cost of connection is high and that up till now it has hindered the extension of this transmission mode which could otherwise be advantageous.

Preferred embodiments of the connection device according to the present invention mitigate the above disadvantages. Indeed, they make it possible to simplify the connection of the wave guides and to reduce the cost thereof without any detrimental effect on the required transmission quality.

The present invention provides a method of connecting two circular wave guide assemblies each comprising an inner wave guide proper and an outer casing; the method comprising the steps of forming a cylindrical sleeve in the end of each casing, each cylindrical sleeve being of larger diameter than the rest of the casing, extending along a predetermined length from the end of the casing and having a flange at the end of the casing; joining the inner wave guides proper by thermo-expansible hoop means lodged inside the sleeves of the outer casings; and welding the flanges together.

According to a particular embodiment of the invention, the casing is not integral with the wave guide proper and the thermo-expansible hoop means comprises a hoop of insulative material.

Alternatively the casing may be integral with the wave guide proper and the thermo-expansible hoop means comprises an assembly of a centering ring and first and second steel hoops force fitted on the respective ends of the wave guides proper to be joined, said hoops having a shoulder in their outer ends for receiving the centering ring.

The present invention also provides a circular wave guide assembly including at least two portions connected according to the method.

The present invention also provides a circular wave guide assembly prepared for connection to another and comprising an inner wave guide proper and an outer casing wherein the ends of the outer casing are formed for connection to other assemblies to have a cylindrical sleeve of larger diameter than the rest of the casing, extending along a predetermined length from the end of the casing and having a flange at the end of the casing.

An embodiment of the present invention given only by way of example and having no limiting character will be described hereinbelow with reference to the accompanying drawings in which:

FIGS. 1*a* to 1*d* show the different phases in the manufacture of a connection device for two wave guide assemblies in which a wave guide proper and its outer casing are not integral with each other; and FIG. 2*a* to 2*d* show the different phases in the manufacture of a connection device for two wave guide assemblies in which a wave guide proper and its outer casing are integral with each other.

FIG. 1*a* shows a half cross-section of one end of a wave guide assembly constituted by a wave guide proper 1 and its outer casing 2 which could be a steel tube.

The outer metal casing 2 is expanded during this first phase along a few centimeters to a few tens of centimeters so as to form a cylindrical sleeve 3 having a larger diameter than the remainder of the casing 2. The cylindrical sleeve 3 ends in a flange 4 which is formed by turning up the end of the sleeve 3. The precision required for the inside diameter of the sleeve 3 is of the order of a tenth of a millimeter, this being easy to obtain with a press by means of a punch and a die preferably for cold operation.

Figure 1B:
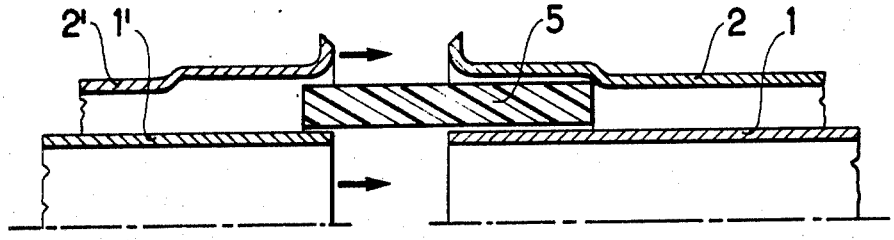

In FIG. 1*b*, a hoop 5 having a high coefficient of expansion and which can be made e.g. of a plastics material such as polycarbonate is heated firstly by any known method and applied up to half its axial length onto the end of the wave guide proper 1.

Figure 1C:
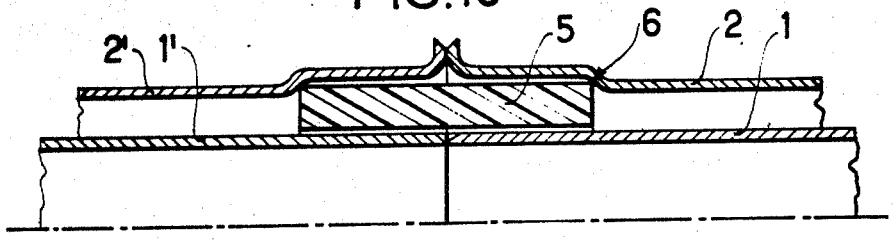

FIG. 1*c* shows the connection of two wave guides 1 and 1'. During this phase, the wave guide proper 1' and its outer casing 2' are brought together along the axis of the wave guides 1–2. The wave guide proper 1' is inserted inside the part of the hoop 5 not containing the guide 1, the hoop 5 still being expanded and leaving a clearance which could be 0.05 millimeters with respect to the wave guides 1 and 1'.

During this bringing together, the hoop 5 abuts against the shoulder 6 of the sleeve 3. The hoop 5 still being expanded leaves a radial clearance which could be 0.5 millimeters in relation to the sleeve 3.

Figure 1D:
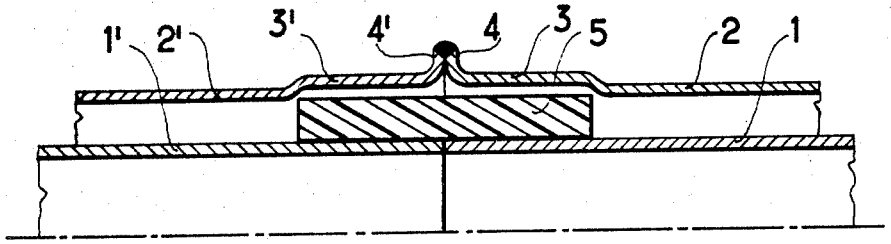

FIG. 1*d* shows the hoop 5 surrounding the two wave guides 1 and 1' after the hoop has cooled. Once the two ends have been connected by the hoop 5 the two flanges 4 and 4' of the adjacent guides are brought together until they come into contact with each other and are welded by any known means (electric arc, high frequency, plasma torch or electron beam welding) so as to form a sealed permanent connection between the casings.

Figure 2A:
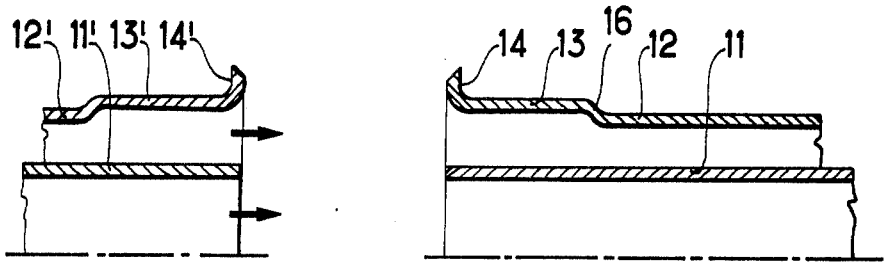

FIG. 2*a* shows an expanded end 13 of an outer casing 12 of a wave guide proper 11. The process is similar to the preceding step shown in FIG. 1*a*. The sleeve 13 has a shoulder 16 and a flange 14.

Figure 2B:
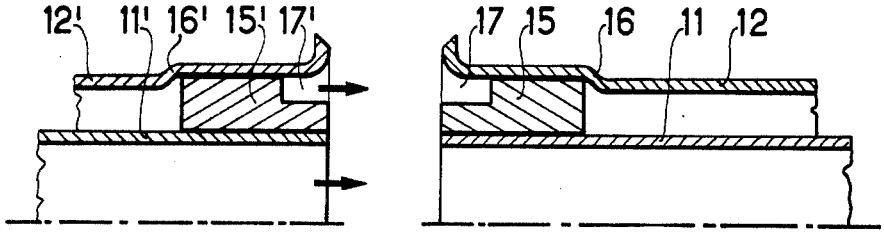

FIG. 2*b* shows a first hoop 15 made e.g. of steel force fitted between the wave guide proper 11 and the sleeve 13. The hoop is installed up to the shoulder 16. A shoulder is machined at 17 on one edge of the hoop 15 and is concentric with the axis of the wave guide. The precision of the machining is sufficient to provide good electrical quality of the connection.

The same operation with a second hoop 15' is carried out on the end of the opposite wave guide. The same elements are referenced with the same numerals, except that the prime symbol has been added for those opposite guides.

Figure 2C:
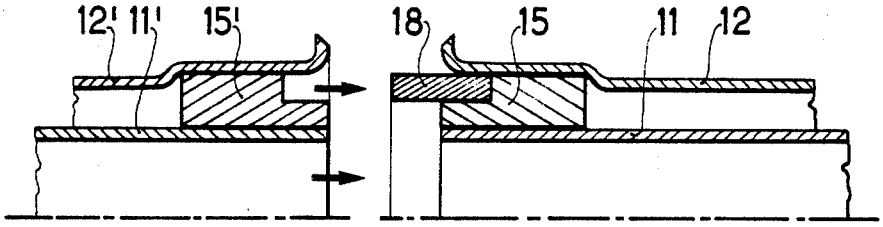

FIG 2*c* shows the insertion of a centering ring 18 inside the shoulder 17. The centering ring 18 is made of treated steel.

Figure 2D:
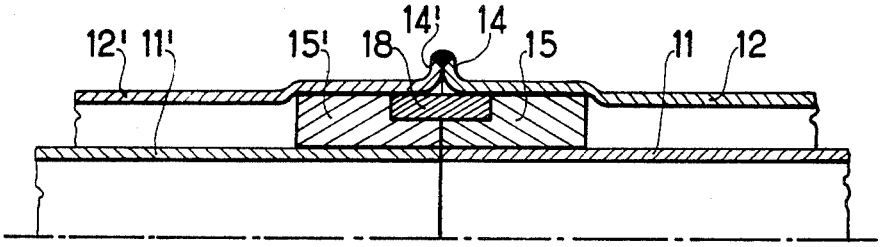

In FIG. 2*d*, the two wave guides are slid until the hoops 15 and 15' come into contact with each other, the centering ring 18 engaging inside the shoulder 17'. The two flanges 14 and 14' are then also in contact with each other and are connected by welding according to the same method as that described with reference to FIG. 1*d*.

The method according to the present invention makes it possible to form connections at a low cost and provides radioelectric transmission quality similar to that of known devices.

Applications come within the field of electromagnetic wave guides.

What I claim is:

1. A method of connecting two circular wave guide assemblies each comprising an inner wave guide proper and an outer casing; the method comprising the steps of: forming a cylindrical sleeve in the end of each casing, each cylindrical sleeve being of larger diameter than the rest of the casing, extending along a predetermined length from the end of the casing and having a flange at the end of the casing; joining the inner wave guides proper by thermo-expansible hoop means lodged inside the sleeves of the outer casings; and welding the flanges together.

2. A method according to claim 1 wherein the casing is not integral with the wave guide proper and the thermo-expansible hoop means comprises a hoop of insulative material.

3. A method according to claim 1 wherein the casing is integral with the wave guide proper and the thermo-expansible hoop means comprises an assembly of a centering ring and first and second steel hoops force fitted on the respective ends of the wave guides proper to be joined, said hoops having a shoulder in their outer ends for receiving the centering ring.

4. A circular waveguide connection assembly, comprising: two inner waveguides (11,11') in end to end relationship; two outer casings (12,12') in end to end relationship, the end (13,13') of each outer casing being formed of said connection so as to have a cylindrical sleeve of larger diameter than the remainder of the casing, extending along a predetermined length from the end of the casing; flange means (14,14') disposed at the end of each of said outer casings, said flange means being welded together; two hoops (15,15') in end to end relationship, said hoops each being of a predetermined length and force fitted between the corresponding inner waveguide and the corresponding sleeve formed by the ends of the outer casings, each being provided with a shoulder; and centering ring means (18) inserted between said shoulders of said hoops.

5. A circular waveguide connection assembly, comprising: two inner waveguides (1,1') in end to end relationship, two outer casings (2,2') in end to end relationship, the end of each outer casing being formed for said connection with a cylindrical sleeve of larger diameter than the remainder of the casing, extending along a predetermined length from the end of the casing; flange means (4,4') disposed at the end of each of said casings, said flange means being welded together; and hoop means formed of a high coefficient of expansion material having a length equal to the sum of said predetermined lengths, being tightly applied around said inner waveguides proper before said flange means are welded together.

* * * * *